US008091268B2

(12) United States Patent
York

(10) Patent No.: US 8,091,268 B2
(45) Date of Patent: Jan. 10, 2012

(54) MULTI-COLOR RETICLE FOR BALLISTIC AIMING

(75) Inventor: Andrew W. York, Portland, OR (US)

(73) Assignee: Leupold & Stevens, Inc., Beaverton, OR (US)

( * ) Notice: Subject to any disclaimer, the term of this patent is extended or adjusted under 35 U.S.C. 154(b) by 1293 days.

(21) Appl. No.: 11/673,530

(22) Filed: Feb. 9, 2007

(65) Prior Publication Data

US 2011/0296733 A1 Dec. 8, 2011

Related U.S. Application Data

(60) Provisional application No. 60/772,014, filed on Feb. 9, 2006.

(51) Int. Cl.
*F41G 1/38* (2006.01)

(52) U.S. Cl. ..... 42/142; 42/130; 42/144; 42/122

(58) Field of Classification Search ..... 42/122, 42/117, 123, 130, 131, 135, 136, 137, 144
See application file for complete search history.

(56) References Cited

U.S. PATENT DOCUMENTS

| | | | | |
|---|---|---|---|---|
| 3,672,782 | A | 6/1972 | Akin, Jr. | |
| 4,325,190 | A | 4/1982 | Duerst | |
| 4,671,165 | A | 6/1987 | Heidmann et al. | |
| 4,743,765 | A | 5/1988 | Ekstrand | |
| 4,993,833 | A | 2/1991 | Lorey et al. | |
| 5,005,308 | A | 4/1991 | Parks | |
| 5,026,158 | A | 6/1991 | Golubic | |
| 5,189,560 | A | 2/1993 | Edwards | |
| 5,291,262 | A | 3/1994 | Dunne | |
| 5,374,986 | A | 12/1994 | Solinsky | |
| 5,623,335 | A | 4/1997 | Bamberger | |
| 5,914,775 | A * | 6/1999 | Hargrove et al. | 356/3.13 |
| 6,073,352 | A | 6/2000 | Zykan et al. | |
| 6,196,455 | B1 | 3/2001 | Robinson | |
| 6,269,581 | B1 | 8/2001 | Groh | |
| 6,516,699 | B2 | 2/2003 | Sammut et al. | |
| 6,591,537 | B2 | 7/2003 | Smith | |
| 6,873,406 | B1 | 3/2005 | Hines et al. | |
| 6,978,569 | B2 * | 12/2005 | Williamson et al. | 42/132 |
| 7,069,684 | B2 | 7/2006 | Smith, III | |
| 7,171,776 | B2 | 2/2007 | Staley, III | |
| 7,255,035 | B2 | 8/2007 | Mowers | |

(Continued)

FOREIGN PATENT DOCUMENTS

| | | |
|---|---|---|
| JP | 10300840 | 11/1998 |

(Continued)

OTHER PUBLICATIONS

International Search Report and Written Opinion, PCT/US2007/003471, mailed May 30, 2011.

*Primary Examiner* — Michael Carone
*Assistant Examiner* — Daniel Troy
(74) *Attorney, Agent, or Firm* — Stoel Rives LLP

(57) ABSTRACT

According an embodiment, a projectile weapon aiming system includes a computer-controllable reticle with crosshairs or other aiming marks having a color and/or illumination that can be selectively changed to provide feedback to a shooter to indicate when the projectile weapon aiming system (and hence the projectile weapon itself) is accurately aimed to compensate for a particular range, inclination, crosswind, and/or other ballistic conditions.

21 Claims, 3 Drawing Sheets

U.S. PATENT DOCUMENTS

| | | | | |
|---|---|---|---|---|
| 7,654,029 | B2 * | 2/2010 | Peters et al. | 42/111 |
| 2005/0091903 | A1 | 5/2005 | Smith | |
| 2005/0198885 | A1 * | 9/2005 | Staley, III | 42/142 |
| 2005/0229468 | A1 | 10/2005 | Zaderey et al. | |
| 2005/0246910 | A1 | 11/2005 | Mowers | |
| 2005/0252064 | A1 | 11/2005 | Williamson et al. | |
| 2005/0268521 | A1 * | 12/2005 | Cox et al. | 42/130 |
| 2006/0156560 | A1 | 7/2006 | Lines et al. | |
| 2006/0225335 | A1 | 10/2006 | Florence et al. | |
| 2007/0137088 | A1 | 6/2007 | Peters et al. | |

FOREIGN PATENT DOCUMENTS

| | | |
|---|---|---|
| JP | 2000356500 | 12/2000 |
| WO | WO 2005/015285 | 2/2005 |

* cited by examiner

MULTI-COLOR RETICLE FOR BALLISTIC AIMING

RELATED APPLICATIONS

This application claims the benefit under 35 U.S.C. §119 (e) from U.S. Provisional Patent Application No. 60/772,014, filed Feb. 9, 2006, which is incorporated herein by reference in its entirety.

TECHNICAL FIELD

This application relates to projectile weapon aiming systems, to reticle configurations for projectile weapon aiming systems, and to aiming and ballistic adjustment methods generally.

BACKGROUND

Projectile weapon aiming systems are discussed herein principally with reference to their use on rifles and embodied in telescopic sights commonly known as riflescopes. It will become apparent, however, that projectile weapon aiming systems may include aiming devices other than riflescopes, such as reflex sights and bow sights for example, and may be used on weapons other than rifles, which are capable of propelling projectiles along substantially predeterminable initial trajectories, e.g., handguns, shotguns, bows, crossbows, artillery, and the like.

A factor that must be taken into account in long-range shooting is the curved trajectory traversed by a bullet or other projectile as it falls from its initial trajectory while traveling the distance from the projectile weapon to the target, i.e., "range." An aiming line of sight extending through a reticle aiming mark of, for example, a riflescope rigidly affixed to the gun, is straight and hence the line of sight can intersect the curved trajectory only at a discrete range. The range at which the line of sight (as determined by the reticle) intersects the curved trajectory of the projectile may also be referred to as the sighted-in distance or sighted-in range. At other ranges the projectile will travel below or above the aiming line of sight, necessitating the use of elevation adjustments to sight-in the projectile weapon at the new range. For either case (e.g., sighting-in a projectile weapon to a predetermined range, for example 100 yards, or adjusting the weapon to be sighted-in at another range) elevation adjustments in such riflescopes are typically made by turning an adjustment mechanism of the riflescope to impart vertical movement of optical elements to adjust the line of sight (as described, for example, in U.S. Pat. No. 3,297,389 to Gibson) or of the reticle to adjust the line of sight (as described, for example, in U.S. Pat. No. 3,058,391 to Leupold), so that the weapon and riflescope are accurately sighted-in to another range (e.g., the range of a target). To adjust for the effect of crosswinds, riflescopes also typically include a separate windage adjustment mechanism for imparting horizontal movement to the optical elements or reticle. In yet other projectile weapon aiming systems, the entire aiming device is adjusted relative to the weapon via an adjustable sight mount.

Adjustment of the elevation and windage is time consuming and may require the shooter to take his or her eyes off the target while manipulating the adjustment mechanisms or measurement tools. For example, U.S. Pat. No. 6,196,455 to Robinson discloses a hand-held analog calculator that, in conjunction with a mil-dot reticle, permits a shooter to determine the range to the target and the necessary elevation adjustment (e.g., in mil-dots or portions thereof) to compensate for bullet drop. U.S. Pat. No. 6,516,699 to Sammut et al. discloses a similar function performed by a hand-held personal digital assistant ("PDA") that enables the user to input information regarding weather, gun and ammunition characteristics, and target information, including range to target. The PDA calculates the adjustments that need to be made to a conventional scope, or the location on the reticle that should be used as an aiming point, in order to hit the target. Both the Robinson device and Sammut device require that the shooter withdraw their attention from their scope.

Consequently, many hunters and military marksmen use ballistic compensation reticles that provide multiple aiming points for aiming at different distances or under different wind conditions. Such reticles employ a ballistic adjustment technique known as holdover (or "come-up") and holdunder (or "come-down") in which the user merely aims the weapon high or low to adjust for ranges different from the sighted-in range. One such ballistic reticle is sold by Leupold & Stevens, Inc. of Beaverton, Oreg., USA under the trademarks BALLISTIC AIMING SYSTEM® and BAS®. Ballistic compensation reticles of this type are also described in U.S. patent application Ser. No. 10/933,856, filed Sep. 3, 2004 and published as US 2005/0229468 A1 and is incorporated herein by reference.

Similarly, U.S. Pat. Nos. 6,591,537 and 7,069,684 to Smith both describe a gun sight reticle defining a system of dimensioned indicia spaced at specific separations to improve aiming accuracy of, for example, a rifle. For each, in addition to the horizontal hairline, the reticle includes four horizontal range-marker lines disposed at specific angular separations below the horizontal hairline in bisected relationship with the center vertical hairline. The spacing of the range marker lines below the center horizontal hairline is proportional to bullet drop at selected ranges. Further, the relative lengths of the range-marking bars on each side of the central vertical crosshair are proportional to a 10 mile per hour crosswind at the target range reflected by each respective range marker.

Rangefinding and/or ballistic compensation reticles have several deficiencies. First, they tend to clutter the field of view, which can inhibit target acquisition and visibility. Second, the number of different discrete ranges for which there are secondary aiming marks is limited and for ranges falling in between those corresponding to the secondary aiming marks, the user must interpolate or guesstimate as to the proper holdover. A similar issue applies to windage adjustments.

Handheld laser rangefinders are now available that allow a user to quickly determine a range to target. Some such rangefinders also include an inclinometer for determining the inclination to target. Inexpensive remote sensors are also available for determining environmental conditions affecting ballistics, including anemometers for detecting wind conditions. For example, U.S. patent application Ser. No. 11/555,591, filed Nov. 1, 2006 and titled "BALLISTIC RANGING METHODS AND SYSTEMS FOR INCLINED SHOOTING" ("the '591 application"), which is incorporated herein by reference, describes a handheld rangefinder including an inclinometer, sensors, a computer processor, and ballistics software for accurately determining aiming adjustment recommendations for a hunter or marksman.

The present inventor has recognized the desirability of simplifying the process of making aiming adjustments to account for ballistics at different ranges and inclinations, for different bullets or projectile types, and other ballistic factors, while achieving a desired degree of accuracy in aim so as to promote taking responsible shots at distant targets.

DETAILED DESCRIPTION OF PREFERRED EMBODIMENTS

Figure 1:
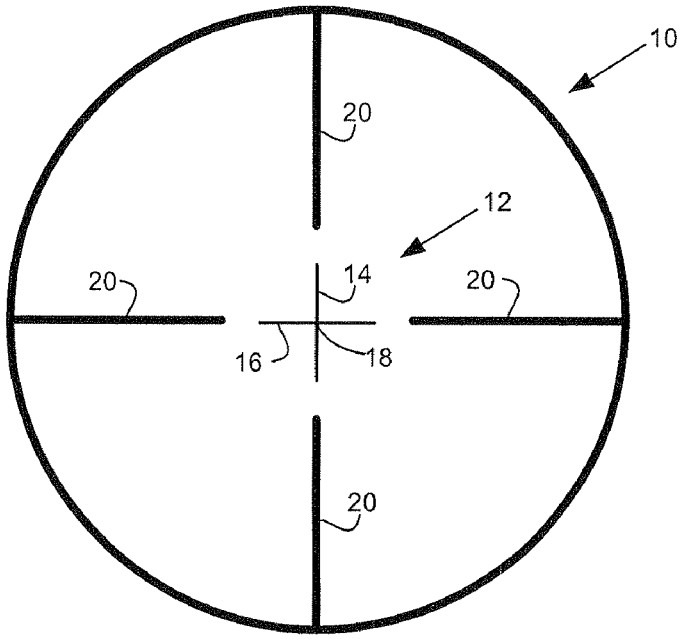
FIG. 1 is a pictorial view of a reticle for a projectile weapon aiming system.

According to one embodiment, a projectile weapon aiming system such as a riflescope, may include a computer-controllable illuminated reticle with crosshairs or other aiming marks having an illumination color that can be selectively changed to provide feedback to a shooter to indicate when the aiming device (and hence the weapon itself) is accurately aimed at a target to compensate for a particular range, inclination, and other ballistic conditions (e.g., the initial velocity of the projectile, the altitude of the projectile weapon above sea level, the barometric pressure, the ambient temperature, the relative humidity, the height of the projectile weapon aiming system above a bore line of the projectile weapon, a compass heading of a line of site, or a geographic location of the projectile weapon). As used herein, target refers to a desired point of impact of the projectile.

The reticle may include any of a variety of known or future-developed technologies for displaying colored and/or illuminated aiming marks, such as LEDs that project color into an edge of an etched glass reticle disc, transmissive OLED displays, transmissive color LCD displays, archery pin sights (e.g., LED and fiber optic), holographic weapon sights, and others. Preferably, the aiming marks are capable of changing colors in response to computer control. For example, aiming marks and/or crosshairs may be changed from one color indicating incorrect aim, to a second color indicating correct aim. Further, tertiary colors may be selectable to indicate other conditions, such as the degree of variation from the correct aim and other information. The colors may be selectable for each of a vertical hold indication and a horizontal hold indication, as further described below.

The aiming recommendations for vertical offset (e.g., holdover or holdunder) and horizontal offset (windage) may be calculated onboard the riflescope via a combination of a built-in laser rangefinder, inclinometer(s), anemometer, digital compass, and ballistics software, as is described in the '591 application. Other possible technologies for measuring wind (in particular crosswinds) include laser Doppler velocimetry, coherent Doppler lidar, MEMS anemometer arrays, and others. Alternatively, the aiming recommendation for holdover and windage may be calculated in a remote device, such as a handheld or portable laser rangefinder and ballistic calculation unit, then transmitted to the riflescope via wireless data communication technologies, such as Bluetooth™, WiFi, or any of a variety of other technologies. Various methods of communication between remote ballistic calculation devices and sensors are described in a U.S. Provisional Patent Application No. 60/771,961 titled "RIFLESCOPE WITH WIRELESS COMMUNICATION CAPABILITIES AND RELATED METHODS" filed on Feb. 9, 2006, which is incorporated herein by reference.

The calculated aiming recommendation may be expressed in terms of the angular elevation and windage adjustments required, in minutes of angle (MOA), to a very high degree of accuracy, such as ¼ MOA increments. An inclinometer onboard the riflescope or the weapon may then be utilized to determine when the right amount of holdover adjustment is made, by accurately measuring the angle of the riflescope relative to a sighted-in angle or line of sight and comparing that to the calculated angular elevation recommendation. Similarly a digital compass onboard the riflescope or the weapon may also be utilized to determine when the right amount of windage adjustment is made, by accurately measuring the direction of aim (e.g., azimuth) of the riflescope relative to the horizontal line of sight between the shooter and the target. When the riflescope is tilted vertically and rotated horizontally to the recommended elevation and windage offset angles (i.e., holdover/holdunder and windage), within a certain error tolerance, the reticle of the riflescope is then activated or its color changed to indicate that the weapon is accurately aimed, thereby providing a visual cue or indication to the shooter.

FIG. 1 illustrates a reticle 10 as viewed through an eyepiece of a projectile weapon aiming system or riflescope. Reticle 10 may include any of a variety of reticle patterns such as crosshairs having vertical and horizontal aiming lines, or any other pattern of aiming marks. In the embodiment shown in FIGS. 1-5, the reticle 10 includes a central crosshair 12 comprising a vertical aiming line 14 and a horizontal aiming line 16 that cross at a primary aiming point 18 of the reticle 10. Four posts 20 radiate from the cross hair 12 to help draw the shooter's eye to the central cross hair.

Figure 2:
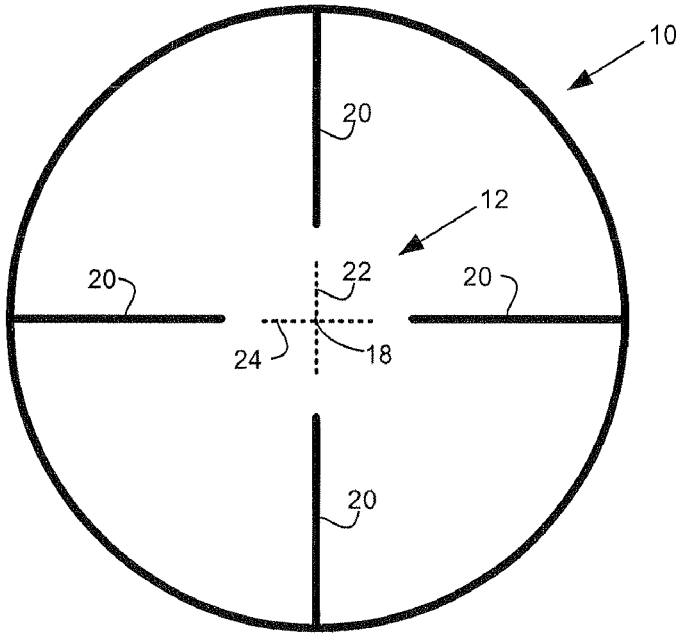
FIG. 2 is a pictorial view of a reticle of an embodiment for a projectile weapon aiming system including a vertical offset indication and a horizontal offset indication.

FIGS. 2-5 illustrate a reticle 10 including vertical aiming line 22 and horizontal aiming line 24 that may be illuminated with alternate colors to indicate whether or not the primary aiming point 18 is properly offset, if necessary, to aim the projectile weapon at a target. Based on the calculated recommended elevation and windage adjustment, and comparison to the measured vertical angle at which the riflescope is held and compass direction, a vertical hold indication and a horizontal hold indication may visually indicate to the shooter whether or not the projectile weapon is correctly aimed. Preferably, the color of the horizontal aiming line 24 and the vertical aiming line 22 may both be illuminated a first color, for example red (as shown in FIG. 2 by fine dashed lines) to indicate that the weapon is held at the wrong vertical angle and horizontal angle to hit the target. Further, portions of horizontal aiming line 24 (e.g., left or right) or portions of the vertical aiming line 22 (e.g., top or bottom), or one or more of the posts 20, may independently illuminate to indicate in which direction or directions the projectile weapon is misaimed.

Figure 3:
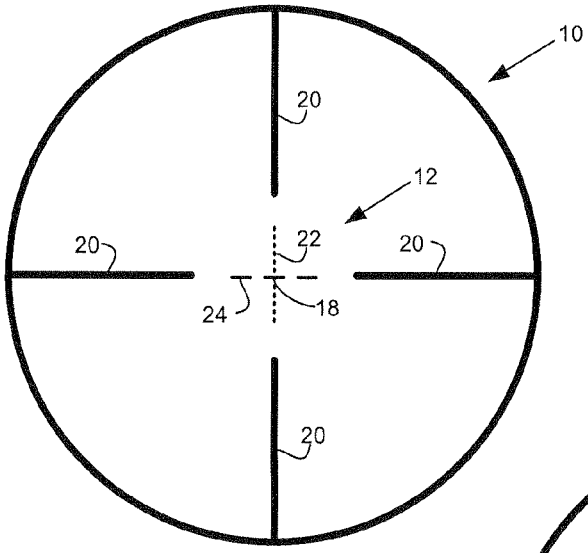
FIG. 3 is a pictorial view of the reticle of FIG. 2, the vertical offset indication indicating that the projectile weapon is properly vertically aimed.

The vertical aiming line 22 and the horizontal aiming line 24 may be illuminated in a second color (e.g., green) to indicate when the projectile weapon is correctly aimed. For example. as shown in FIG. 3, when the correct vertical offset or holdover adjustment is made, but the incorrect horizontal offset or windage adjustment is made for wind, then the horizontal aiming line 24 may illuminate in a second color, for example green (as indicated by a coarse dashed line), while the vertical aiming line 22 may be illuminated in red (as indicated by fine dashed line). As the horizontal aiming line 24 is used to vertically aim the projectile weapon, the illumination of the horizontal aiming line 24 in green, for example, visually indicates that the shooter has properly vertically offset or holdover adjusted the projectile weapon without requiring that the shooter substantially withdraw focus from the primary aiming point 18.

Figure 4:
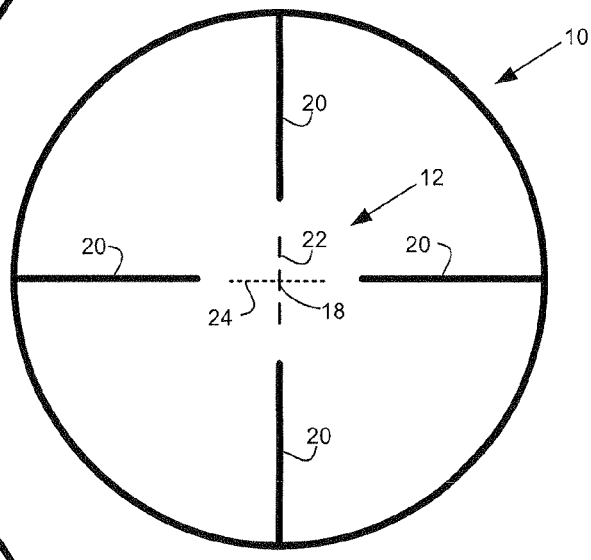
FIG. 4 is a pictorial view of the reticle of FIG. 2, the horizontal offset indication indicating that the projectile weapon is properly horizontally aimed.

As shown in FIG. 4, when the correct horizontal offset or windage adjustment is made for wind, but the incorrect vertical offset or holdover adjustment is made, then the vertical aiming line 22 is shown a second color, for example green (as indicated by a coarse dashed line) while the horizontal aiming line 24 may be illuminated red (as indicated by a fine dashed line). As the vertical aiming line 22 is used to horizontally aim the projectile weapon, the illumination of the vertical aiming line 22 in green, for example, visually indicates that the shooter has properly horizontally offset or adjusted the projectile weapon without requiring that the shooter substantially withdraw focus from the primary aiming point 18.

Figure 5:
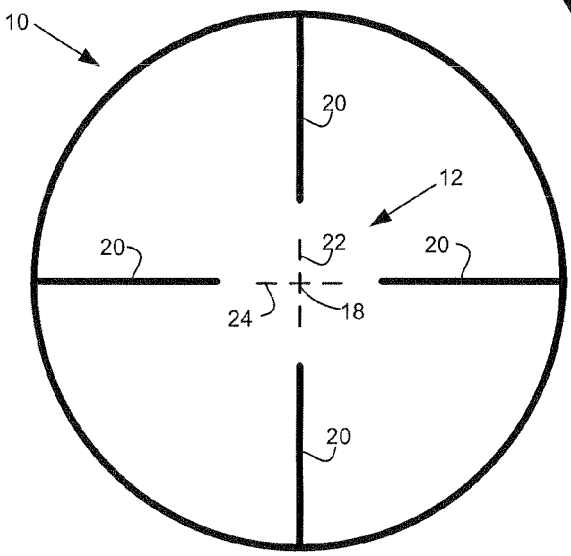
FIG. 5 is a pictorial view of the reticle of FIG. 2, the vertical offset indication and the horizontal offset indication indicating that the projectile weapon is properly vertically and horizontally aimed.

Finally, as shown in FIG. 5, if both the vertical offset or holdover adjustment and the horizontal offset or windage adjustment is correct, both the vertical aiming line 22 and the horizontal aiming line 24 are displayed with green illumination (as indicated by coarse dashed lines) indicating to the shooter that the weapon is accurately aimed and a shot can be taken.

Alternatively, in an embodiment, the vertical aiming line 22 may serve as the vertical hold indication and the horizontal aiming line 24 may serve as the horizontal hold indication based on the preferences of the shooter.

In an embodiment, the vertical hold indication or mark, the horizontal hold indication or mark, and/or the entire reticle or some part of the reticle may indicate, by changing appearance (e.g., color, illumination, illumination intensity, and/or pattern), that the target is substantially located at a predetermined range. For example, a projectile weapon may be sighted in at a particular distance or range, in an embodiment based on the effective range of the projectile weapon. While a shooter is viewing a target through the projectile weapon aiming system, the appearance of the vertical hold indication or mark, the horizontal hold indication or mark, and/or the entire reticle or some part of the reticle may change to indicate that the target is close to or within the distance or range to which the projectile weapon is sighted in at which point the shooter may aim (e.g., with primary aiming point 18) substantially without any vertical offset or horizontal offset. Alternatively, the distance or range at which the vertical hold indication or mark, the horizontal hold indication or mark, and/or the entire reticle or some part of the reticle change appearance may be different than the distance or range at which the projectile weapon is sighted in. For example, a hunter or marksman may be stationary (e.g., in a tree stand or hide) and the target may be mobile. The hunter or marksman may sight the target and receive visual indication as described when the target is located at a predetermined range (e.g., the sighted-in range of the weapon, an effective range of the weapon, or other predetermined range selected by the hunter or marksman). Alternatively, the hunter or marksman may be mobile while the target is stationary or mobile.

In still a further embodiment, more than two colors could be used to indicate when the aim or target range is getting close, but not yet within a predetermined error tolerance or range. In an embodiment, a yellow color could mean "getting close." For example, each of the vertical aiming line 22 and the horizontal aiming line 24 may illuminate with a third color, in an embodiment yellow, to indicate to the shooter that substantially only fine aiming motion may be necessary to properly align the primary aiming point 18. Alternatively, the yellow color may indicate that the target is approaching a predetermined range. Similarly, blinking the illumination or altering the intensity of the illumination independent of or in conjunction with changing the color of the vertical aiming line 22 and the horizontal aiming line 24 may further aid the shooter to visibly confirm that the shooter has properly aimed the projectile weapon or that a target is coming into range.

Figure 6:
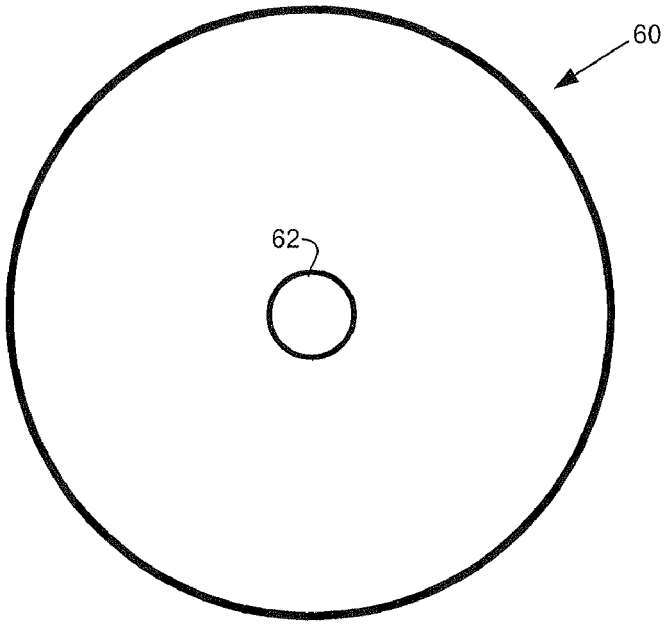
FIG. 6 is a pictorial view of a reticle of an alternate embodiment for a target at a first range.
Figure 7:
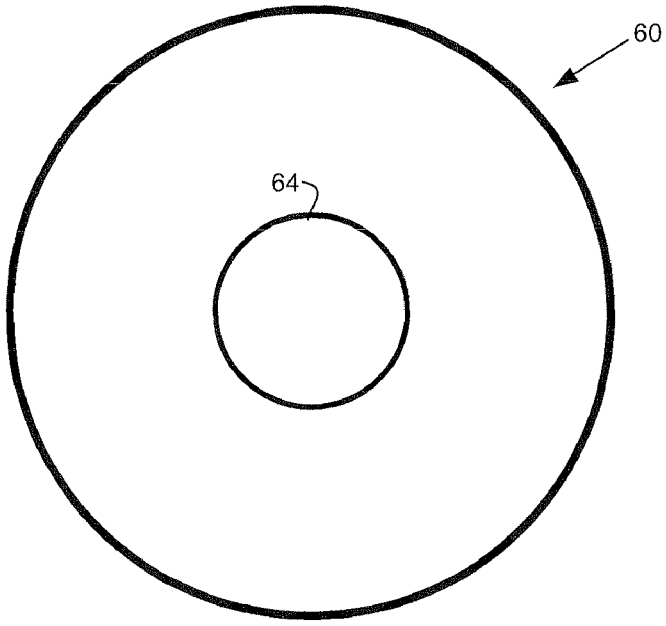
FIG. 7 is a pictorial view of the reticle of FIG. 6 for a target at a second range.

A turkey hunter, for example armed with a shotgun, may configure the reticle of an embodiment to indicate red when the target is greater than 50 yards away, to indicate yellow when the turkey is between 40 and 50 yards, and to indicate green when the turkey is within 40 yards. Other ranges or combinations are possible. Further, in an embodiment, the pattern of the reticle may change or be adjusted based on the range to the target to reflect the pattern or spread of the shot. For example, FIG. 6 illustrates reticle 60 including a circle 62. As the range to the target increases, as illustrated by FIG. 7, the reticle 60 of an embodiment may display a circle 64 with an increased diameter compared to circle 62 to reflect the increased area of the shot pattern or spread at the increased distance. Other patterns, perimeters, and regular or irregular indications of shot spread are possible. In an embodiment, the reticle may be field calibrated as, for example, the hunter changes chokes, ammunition (i.e., shot size and/or powder load) and/or in response to measuring the shot pattern or spread at a known distance. Further, it is to be understood that the reticle of an embodiment may apply to other weapons that have a range-based spread to their projectile, projectiles, or other discharge (e.g., gases, liquids, solid or liquid aerosols, flechettes, cluster munitions, and the like).

Though described with reference to a crosshair style reticle, it is to be understood that the visible indication of proper vertical and horizontal hold may be applied to other reticle styles as part of the reticle itself or as independent visible vertical hold and horizontal hold indications adjacent to the reticle. Further, though described with particular colors, other colors (e.g., hue, lightness, and saturation) and intensities may be used to indicate to a shooter whether or not a projectile weapon is properly aimed. Similarly, the vertical hold indication and the horizontal hold indication may also communicate the aiming accuracy via patterns, flashing displays, or the like in the absence of alternating colors.

It will be obvious to those having skill in the art that many changes may be made to the details of the above-described embodiments without departing from the underlying principles of the invention. The scope of the present invention should, therefore, be determined only by the following claims.

The invention claimed is:

1. An assembly for a projectile weapon aiming system comprising:

a reticle including an aiming mark superposed on a field of view of the projectile weapon aiming system and indicating a primary aiming point along a line of sight of the projectile weapon aiming system, wherein the primary aiming point indicates an expected impact location of a projectile at a selected range at which the projectile weapon aiming system is sighted-in; and a non-alphanumeric visual aiming aid including a vertical hold mark responsive to a range to a target, the vertical hold mark having a first appearance indicating that the range to the target is different from the selected range, and wherein the first appearance also indicates that the primary aiming point is not properly vertically offset relative to an image of the target viewed through the projectile weapon aiming system to hit the target with a projectile when the projectile weapon aiming system is mounted on a projectile weapon, and a second appearance indicating that the primary aiming point is properly vertically offset from the image of the target viewed through the projectile weapon aiming system to hit the target with a projectile when the projectile weapon aiming system is mounted on a projectile weapon wherein the vertical hold mark includes a horizontal aiming line of the reticle intersecting the primary aiming point.

2. The assembly of claim 1, wherein the first appearance of the vertical hold mark and the second appearance of the vertical hold mark differ in color.

3. The assembly of claim 1, wherein the first appearance of the vertical hold mark and the second appearance of the vertical hold mark differ in at least one of illumination, illumination intensity, pattern, or blink rate.

4. The assembly of claim 1, wherein the vertical hold mark is responsive to an inclination of the line of sight to the target.

5. The assembly of claim 1, wherein the vertical hold mark changes appearance to indicate whether a hold-over or a hold-under is needed to properly aim the projectile weapon at the target.

6. The assembly of claim 1, the aiming aid further comprising:

a horizontal hold mark responsive to a crosswind, the horizontal hold mark having a first appearance indicating that the primary aiming point is not properly horizontally offset relative to the image of the target viewed through the projectile weapon aiming system to hit the target with a projectile when the projectile weapon aiming system is mounted on a projectile weapon, and a second appearance indicating that the primary aiming point is properly horizontally offset from the image of the target viewed through the projectile weapon aiming system to hit the target with a projectile when the projectile weapon aiming system is mounted on a projectile weapon.

7. The assembly of claim 6, wherein the first appearance of the horizontal hold mark and the second appearance of the horizontal hold mark differ in color.

8. The assembly of claim 6, wherein the first appearance of the horizontal hold mark and the second appearance of the horizontal hold mark differ in at least one of illumination, illumination intensity, pattern, or blink rate.

9. The assembly of claim 1, wherein the vertical hold mark is responsive to a ballistic calculation device.

10. The assembly of claim 9, wherein the ballistic calculation device determines at least one of an initial velocity of the projectile, a ballistic property of the projectile, an altitude of the projectile weapon above sea level, a barometric pressure, an ambient temperature, a relative humidity, a height of the projectile weapon aiming system above a bore line of the projectile weapon, a compass heading of a line of site, or a geographic location of the projectile weapon.

11. An optical aiming device including the assembly of claim 1.

12. A method of aiming a projectile weapon with an optical sighting device comprising:

determining a range to a target;

displaying, by the optical sighting device an aiming mark indicating a primary aiming point along a line of sight of the optical sighting device, wherein the primary aiming point indicates an expected impact location of a projectile at a selected range at which the projectile weapon aiming system is sighted-in;

displaying, by the optical sighting device a non-alphanumeric vertical hold mark, wherein the non-alphanumeric vertical hold mark includes a horizontal aiming line of the aiming mark intersecting the primary aiming point, the non-alphanumeric vertical hold mark having a first appearance indicating that the range to the target is different from the selected range, and wherein the first appearance indicates that the primary aiming point is not properly vertically offset relative to an image of the target viewed through the optical sighting device to hit the target with a projectile when the projectile weapon aiming system is mounted on a projectile weapon; and in response to the optical sighting device being moved to vertically offset the primary aiming point from the image of the target viewed through the optical sighting device, displaying, by the optical sighting device the non-alphanumeric vertical hold mark, the non-alphanumeric vertical hold mark having a second appearance indicating when the primary aiming point is properly vertically offset to hit the target with a projectile when the projectile weapon aiming system is mounted on a projectile weapon.

13. The method of claim 12 wherein the first appearance of the vertical hold mark and the second appearance of the vertical hold mark differ in color.

14. The method of claim 12 further comprising:

determining a crosswind; and displaying, by the optical sighting device a horizontal hold mark, the horizontal hold mark having a first appearance indicating that the primary aiming point is not properly horizontally offset relative to the image of the target viewed through the optical sighting device to hit the target with a projectile when the projectile weapon aiming system is mounted on a projectile weapon;

in response to the optical sighting device being moved to horizontally offset the primary aiming point from the image of the target viewed through the optical sighting device, displaying, by the optical sighting device the horizontal hold mark, the horizontal hold mark having a second appearance indicating when the primary aiming point is properly horizontally offset to hit the target with a projectile when the projectile weapon aiming system is mounted on a projectile weapon.

15. The method of claim 14 wherein the first appearance of the horizontal hold mark and the second appearance of the horizontal hold mark differ in color.

16. An assembly for a projectile weapon aiming system comprising:

a reticle including an aiming mark superposed on a field of view of the projectile weapon aiming system and indicating a primary aiming point along a line of sight of the projectile weapon aiming system, wherein the primary aiming point indicates an expected impact location of a projectile at a selected range at which the projectile weapon aiming system is sighted-in; and a non-alphanumeric visual aiming aid including a vertical hold mark responsive to a range to a target, the vertical hold mark having a first appearance indicating that the range to the target is different from the selected range, and wherein the first appearance also indicates that the primary aiming point is not properly vertically offset relative to an image of the target viewed through the projectile weapon aiming system to hit the target with a projectile when the projectile weapon aiming system is mounted on a projectile weapon, and a second appearance indicating that the primary aiming point is properly vertically offset from the image of the target viewed through the projectile weapon aiming system to hit the target with a projectile when the projectile weapon aiming system is mounted on a projectile weapon;

wherein the vertical hold mark includes a vertical aiming line of the reticle intersecting the primary aiming point.

17. The assembly of claim 16, wherein at least a portion of the vertical aiming line has a third appearance indicating which direction to move the primary aiming point to properly vertically offset to aim a projectile weapon at the target when the projectile weapon aiming system is mounted on the projectile weapon.

18. An assembly for a projectile weapon aiming system comprising:

a reticle including an aiming mark superposed on a field of view of the projectile weapon aiming system and indicating a primary aiming point along a line of sight of the projectile weapon aiming system, wherein the primary aiming point indicates an expected impact location of a projectile at a selected range at which the projectile weapon aiming system is sighted-in; and a non-alphanumeric visual aiming aid including a vertical hold mark responsive to a range to a target, the vertical hold mark having a first appearance indicating that the range to the target is different from the selected range, and wherein the first appearance also indicates that the primary aiming point is not properly vertically offset relative to an image of the target viewed through the projectile weapon aiming system to hit the target with a projectile when the projectile weapon aiming system is mounted on a projectile weapon, and a second appearance indicating that the primary aiming point is properly vertically offset from the image of the target viewed through the projectile weapon aiming system to hit the target with a projectile when the projectile weapon aiming system is mounted on a projectile weapon a horizontal hold mark responsive to a crosswind, the horizontal hold mark having a first appearance indicating that the primary aiming point is not properly horizontally offset relative to the image of the target viewed through the projectile weapon aiming system to hit the target with a projectile when the projectile weapon aiming system is mounted on a projectile weapon, and a second appearance indicating that the primary aiming point is properly horizontally offset from the image of the target viewed through the projectile weapon aiming system to hit the target with a projectile when the projectile weapon aiming system is mounted on a projectile weapon;

wherein the vertical hold mark includes a horizontal aiming line of the reticle intersecting the primary aiming point; and wherein the horizontal hold mark includes a vertical aiming line of the reticle intersecting the primary aiming point.

19. An assembly for a projectile weapon aiming system comprising:

a reticle including an aiming mark superposed on a field of view of the projectile weapon aiming system and indicating a primary aiming point along a line of sight of the projectile weapon aiming system, wherein the primary aiming point indicates an expected impact location of a projectile at a selected range at which the projectile weapon aiming system is sighted-in; and a non-alphanumeric visual aiming aid including a vertical hold mark responsive to a range to a target, the vertical hold mark having a first appearance indicating that the range to the target is different from the selected range, and wherein the first appearance also indicates that the primary aiming point is not properly vertically offset relative to an image of the target viewed through the projectile weapon aiming system to hit the target with a projectile when the projectile weapon aiming system is mounted on a projectile weapon, and a second appearance indicating that the primary aiming point is properly vertically offset from the image of the target viewed through the projectile weapon aiming system to hit the target with a projectile when the projectile weapon aiming system is mounted on a projectile weapon a horizontal hold mark responsive to a crosswind, the horizontal hold mark having a first appearance indicating that the primary aiming point is not properly horizontally offset relative to the image of the target viewed through the projectile weapon aiming system to hit the target with a projectile when the projectile weapon aiming system is mounted on a projectile weapon, and a second appearance indicating that the primary aiming point is properly horizontally offset from the image of the target viewed through the projectile weapon aiming system to hit the target with a projectile when the projectile weapon aiming system is mounted on a projectile weapon;

wherein the vertical hold mark includes a vertical aiming line of the reticle intersecting the primary aiming point; and wherein the horizontal hold mark includes a horizontal aiming line of the reticle intersecting the primary aiming point.

20. The assembly of claim 19, wherein:

at least a portion of the vertical aiming line has a third appearance indicating which direction to move the primary aiming point to properly vertically offset to aim a projectile weapon at the target when the projectile weapon aiming system is mounted on the projectile weapon; and at least a portion of the horizontal aiming line has a fourth appearance indicating which direction to move the primary aiming point to properly horizontally offset to aim the projectile weapon at the target when the projectile weapon aiming system is mounted on the projectile weapon.

21. A method of aiming a projectile weapon with an optical sighting device comprising:

determining a range to a target;

displaying, by the optical sighting device an aiming mark indicating a primary aiming point along a line of sight of the optical sighting device, wherein the primary aiming point indicates an expected impact location of a projectile at a selected range at which the projectile weapon aiming system is sighted-in;

displaying, by the optical sighting device a non-alphanumeric vertical hold mark, wherein the non-alphanumeric vertical hold mark includes a vertical aiming line of the aiming mark intersecting the primary aiming point, the non-alphanumeric vertical hold mark having a first appearance indicating that the range to the target is different from the selected range, and wherein the first appearance indicates that the primary aiming point is not properly vertically offset relative to an image of the target viewed through the optical sighting device to hit the target with a projectile when the projectile weapon aiming system is mounted on a projectile weapon; and in response to the optical sighting device being moved to vertically offset the primary aiming point from the image of the target viewed through the optical sighting device, displaying, by the optical sighting device the non-alphanumeric vertical hold mark, the non-alphanumeric vertical hold mark having a second appearance indicating when the primary aiming point is properly vertically offset to hit the target with a projectile when the projectile weapon aiming system is mounted on a projectile weapon.

* * * * *